US008650996B2

(12) United States Patent
Boyer, Jr.

(10) Patent No.: US 8,650,996 B2
(45) Date of Patent: Feb. 18, 2014

(54) FILM PERFORATION METHOD

(71) Applicant: Ronald S. Boyer, Jr., Northumberland, PA (US)

(72) Inventor: Ronald S. Boyer, Jr., Northumberland, PA (US)

( * ) Notice: Subject to any disclaimer, the term of this patent is extended or adjusted under 35 U.S.C. 154(b) by 0 days.

(21) Appl. No.: 13/901,209

(22) Filed: May 23, 2013

(65) Prior Publication Data

US 2013/0247729 A1 Sep. 26, 2013

Related U.S. Application Data

(63) Continuation of application No. 12/217,576, filed on Jul. 7, 2008.

(60) Provisional application No. 61/066,042, filed on Feb. 14, 2008.

(51) Int. Cl.
*B26F 1/10* (2006.01)

(52) U.S. Cl.
USPC ..... 83/13; 83/660

(58) Field of Classification Search
USPC ..... 83/13, 660, 170, 171
See application file for complete search history.

(56) References Cited

U.S. PATENT DOCUMENTS 3,348,022 A * 10/1967 Schirmer ..... 219/384
3,682,028 A * 8/1972 Clayton et al. ..... 83/30
3,707,102 A * 12/1972 Huppenthal et al. ..... 83/171
3,719,736 A * 3/1973 Woodruff ..... 264/156
3,762,255 A * 10/1973 Clash et al. ..... 83/309
T920,017 I4 * 3/1974 Billinghurst ..... 83/16
4,167,131 A * 9/1979 Habas et al. ..... 84/304
4,220,272 A * 9/1980 Danti ..... 225/2
5,317,942 A * 6/1994 Nakajima ..... 83/50
5,895,006 A * 4/1999 Karaki et al. ..... 242/525.4
6,016,730 A * 1/2000 Tsuzaki et al. ..... 83/76.1
6,062,120 A * 5/2000 Tsuzaki et al. ..... 83/76.1
7,386,924 B2 * 6/2008 Muth et al. ..... 28/106
8,168,102 B2 * 5/2012 Di Berardino ..... 264/156
2005/0087048 A1 * 4/2005 Knaak et al. ..... 83/13
2009/0205471 A1 * 8/2009 Boyer, Jr. ..... 83/30

* cited by examiner

*Primary Examiner* — Sean Michalski

(74) *Attorney, Agent, or Firm* — Wendy W. Koba

(57) ABSTRACT

A method of creating perforations in wrapping film uses an apparatus that contains a plurality of needle points (or other piercing features) formed along a free-wheeling support bar. The bar is positioned to contact the film while it is being unrolled and is in a 'tensioned ' state (in some embodiments, immediately prior to contacting the element to be wrapped). In performing the method, the free-wheeling perforation apparatus contacts a mechanized film roller such that the exposed needle points rotate against the mechanized roller and make the perforations in the film as it travels over the film roller. As long as the film roller is formed of a pliable material, the needles will pierce the film and create the desired perforations. The size and placement of needles can be adjusted to provide the required pattern of perforations, as well as dictate the size of the actual perforations.

10 Claims, 8 Drawing Sheets

FILM PERFORATION METHOD

CROSS-REFERENCE TO RELATED APPLICATIONS

This application is a continuation of U.S. application No. 12/217,576, filed Jul. 7, 2008, which claims the benefit of U.S. Provisional Application No. 61/066,042, filed Feb. 14, 2008.

TECHNICAL FIELD

The present invention relates to a method for creating perforations in a roll of film as it is being unwrapped and, more particularly, to the utilization of a rotating needle apparatus for creating perforations in a film as it is being unrolled.

BACKGROUND OF THE INVENTION

Stretch wrap films of the prior art are used in connection with a wide variety of overwrap packaging applications. In many applications, these films are required to be air and moisture vapor permeable materials. Techniques have been developed to introduce through-holes (i.e., perforations) into the film for such a purpose. In order to make a thin film with perforations, the prior art generally included a stretching apparatus to thin-out the film and a separate "punching" apparatus for introducing perforations into the stretched film. One exemplary method of producing such films is disclosed in U.S. Pat. No. 6,296,469 issued to M. Suzuki et al. on Oct. 2, 2001. In the Suzuki et al. apparatus, a pair of punching rollers is used which sandwich the film between the rollers.

U.S. Pat. No. 4,765,120, issued to T. E. Phillips on Aug. 23, 1988 discloses a device for perforating a film while wrapping a load. In particular, the Phillips arrangement includes electrodes positioned proximate to the film and an arrangement for generating an arc across the electrodes to form the perforations in the film. Such an arrangement is not considered to be well-suited for situations where the presence of constant arcing may damage the product being wrapped, the wrapping machine and/or other products/machines in the general area of the arcing equipment.

Another type of perforating apparatus is disclosed in U.S. Pat. No. 5,802,945, issued to F. Brinkimeier et al. on Sep. 8, 1998, which describes the use of a series of "needles" to introduce perforations into a roll of film. In order to be able to create a variety of perforation patterns and/or holes of varying diameter in the film, a needle roller arrangement is used that includes several separate needle rollers arranged in a freely rotatable manner in a rotary frame. One of the needle rollers interacts with a brush roller for perforating a film which passes between the brush roller and the needle roller.

U.S. Pat. No. 5,935,681 issued to H. K, Paulett on Aug. 10, 1999 discloses another arrangement for forming "air permeable" stretch film, where in this case the film comprises separate first and second layers of polymeric film (linear low density polyethylene) which is capable of stretching at least 150% beyond its original length. The layers will naturally cling together to form a laminate. Perforations are formed in the laminate by applying a "hot pin" to the laminate, whereby the polymeric film is melted. As the melt hardens, the perforations become defined by the welds, or reinforcements, which add strength to the film.

Laser-based systems have also been developed for creating perforations of a known, controlled sized along a roll of wrapping film (usually a plastic material, although other film materials may be used). See, for example, U.S. Pat. No. 6,730,874 issued to E. Varriano-Marston on May 4, 2004. In operation, a roll of plastic film is fed into a laser perforation apparatus, where the film is unrolled and perforated and thereafter taken up on an output reel. The laser-perforated roll is then ready for use at the food packaging machine.

One problem with many of these film perforation arrangements is that the perforating apparatus is generally not co-located with the items being wrapped; delays may occur in obtaining the perforated film at the plant where the wrapping is taking place. Further, the need to completely unroll and then re-roll the plastic film during the prior art perforation processes tends to create stress across and along the film, creating folds, offsets in the wrapped layers, and the like, which may lead to tears or other problems during the actual wrapping process.

Thus, a need remains in the art for an improved arrangement for creating perforations in the film used to wrap food products.

SUMMARY OF THE INVENTION

The need remaining in the prior art is addressed by the present invention, which relates to a method for creating perforations in a roll of film as it is being unwrapped and, more particularly, to the utilization of a rotating needle apparatus for creating perforations in a film as it is being unrolled In accordance with the present invention, a rotating perforation apparatus containing a plurality of needle points (or other piercing features) is positioned to contact the film while it is being unrolled and is in a 'tensioned' state (in some embodiments, immediately prior to contacting the element to be wrapped). In one embodiment, the rotating perforation apparatus is disposed along a bar which contacts a film roller and makes the perforations in the film as it travels across the film roller. As long as the film roller is formed of a pliable material, the needles will pierce the film and create the desired perforations. The size and placement of needles can be adjusted to provide the required pattern of perforations, as well as dictate the size of the actual perforations.

It is an advantage of the method of the present invention that a conventional film roller (which is a mechanically-driven apparatus) is used to effectuate the unrolling of the film from its stock "roll". Therefore, in performing the perforation process of the present invention, the rotating perforation apparatus is "free-wheeling" (i.e., not driven) such that when it is placed against the driven film roller, the rotating perforation apparatus will naturally counter-rotate against the driven film roller and allow for the needle points to rotate against the film at essentially the same speed as the film is unrolling—eliminating the possibility of tears or jams occurring during the perforation step.

In one embodiment, the perforation method of the present invention may be used in an in-line fashion, applying perforations immediately prior to the film being placed over the item(s) being wrapped. Alternatively, the perforation method of the present invention may be used to form a large roll of perforated film which is thereafter used to wrap various items. Indeed, in one embodiment discussed in detail below, the needle points may be arranged along the perforation apparatus such that different sections of the film will receive different perforation patterns (including, perhaps, not forming perforations along selected widths of the film). The ability of the perforation method of the present invention to modify the perforation pattern is especially well-suited when used with the "large roll" of film, which may then be cut into smaller sections, each section have a different, pre-defined perforation pattern.

In a preferred embodiment, the perforation method utilizes a plurality of "rings", each ring have a number of needle points disposed around the periphery thereof. The rings are inserted along a cylindrical support bar, which then forms the rotating perforation apparatus. The rings and support bar may further include a keying arrangement to ensure for alignment between the plurality of rings inserted along the bar (the alignment of the rings thus defining the perforation pattern that will be formed in the film). The rings may be re-configured in their placement to achieve different perforation patterns and, in one embodiment, may be interspersed with rings not including any needles, allowing for sections of a film to not be perforated as it passes between the driven film roller and the rotating perforation apparatus.

Other and further embodiments and advantages of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Figure 1:
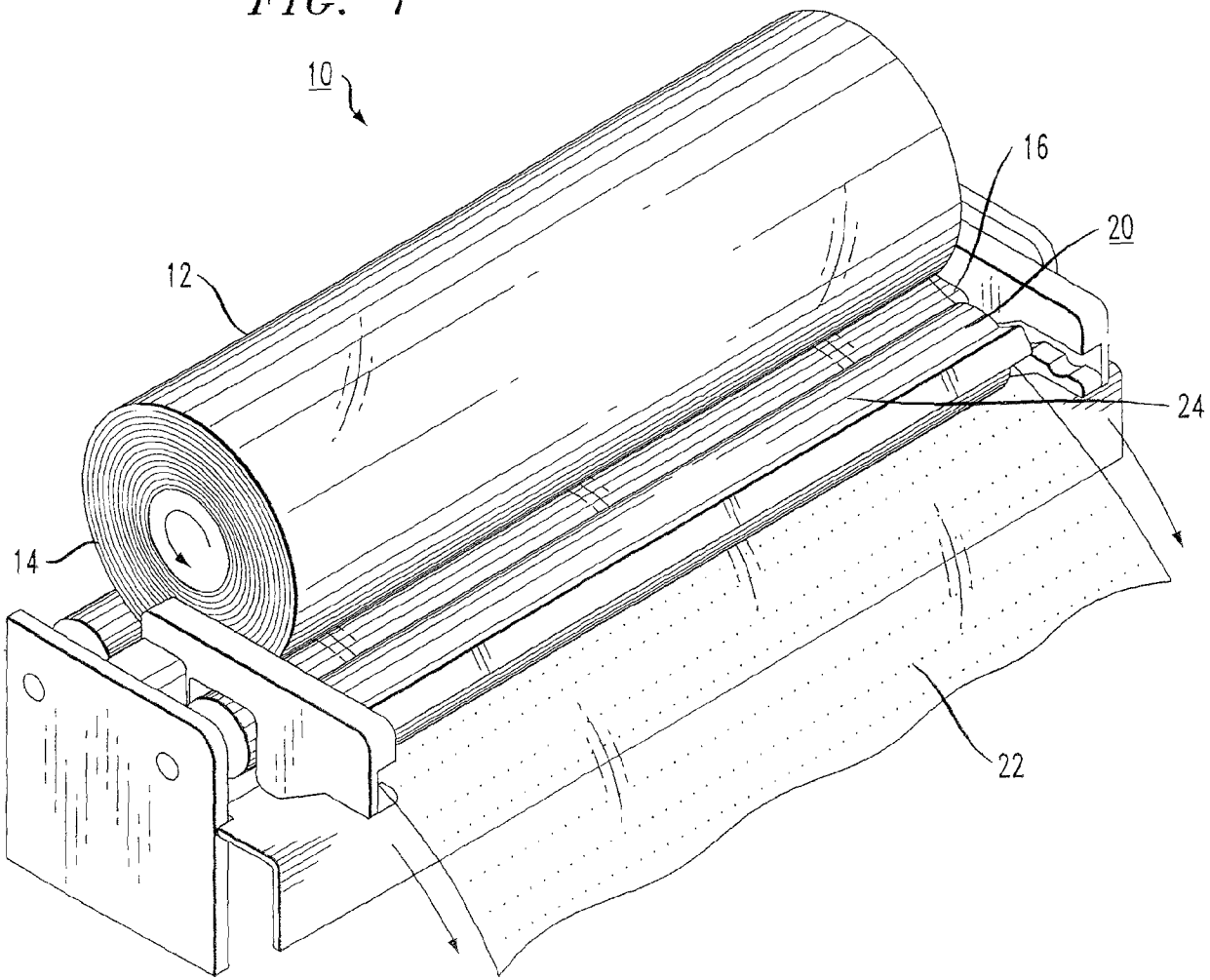
FIG. 1 illustrates an exemplary film feed apparatus for providing in-line perforation of a wrapping film in accordance with the present invention.

FIG. 1 illustrates an exemplary film feed apparatus 10 for providing in-line perforation of a wrapping film in association with an in-line perforation apparatus 20 of with the present invention. Film feed apparatus 10 includes a stock, conventional roll 12 of wrapping film 14 (where this film may be any suitable type of plastic, foil, etc., used in a wrapping process). As film 14 is unwound, it is fed from underneath roll 12 and over the top of a driven roller 16. As controlled by the speed of driven roller 16, film 14 will exit apparatus 10 in the manner indicated by the arrows. In accordance with the present invention and described in detail below, in-line perforation apparatus 20 is positioned to create perforations 22 in film 14 as it exits apparatus 10.

Figure 2:
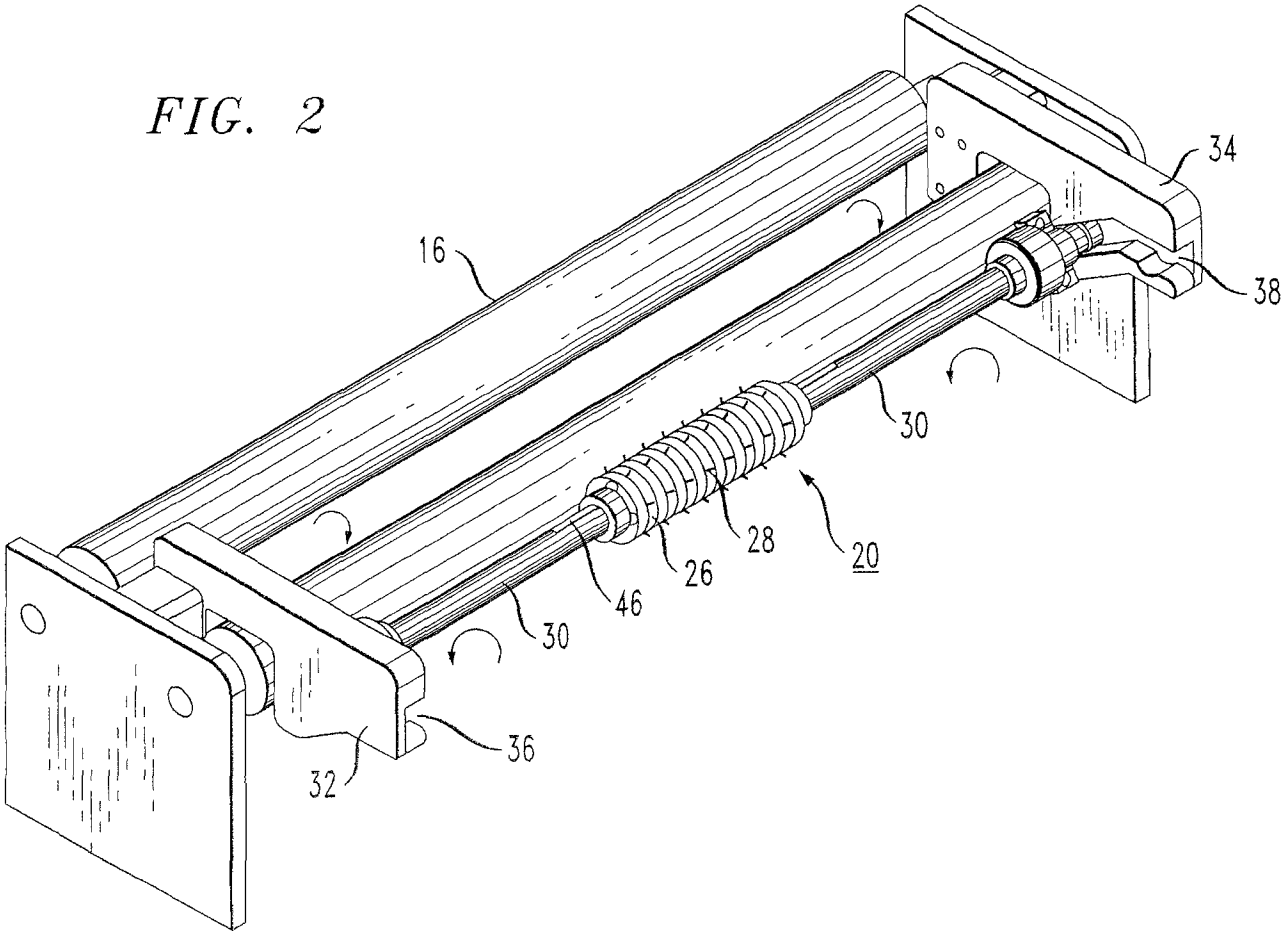
FIG. 2 is another view of the apparatus of FIG. 1, with a covering element removed to expose the inventive in-line perforation apparatus.

In the view of FIG. 1, the actual working parts of in-line perforation apparatus 20 are hidden by a protective cover 24. FIG. 2 is another view of apparatus 10 of FIG. 1, in this case with film roll 12 taken away, and protective cover 24 removed to expose the various components of in-line perforation apparatus 20. As shown, apparatus 20 includes a perforation member 26 which is formed to include a plurality of needle points 28 (or other sharp elements capable of forming perforations in films). Perforation member 26 is located along a central region of a free-wheeling support bar 30. As shown in FIG. 2, support bar 30 is positioned against driven roller 16. Therefore, as driven roller 16 rotates clockwise (as shown by the arrows in FIG. 2), free-wheeling support bar 30 will naturally rotate counter-clockwise at the same rate of rotation as driven roller 16. It is an advantage of the present invention, therefore, that the in-line perforation apparatus does not itself need to be motorized; rather, it will utilize the rotational motion of the film roller apparatus itself to rotate the needles against the film.

The rotation of support bar 30 against driven roller 16 will therefore bring needle points 28 into contact with film 14 as it passes over roller 16 (see FIG. 1), creating perforations 22 in film 14. Advantageously and as described in detail below, the size and location of the perforations is easily controlled by properly configuring the arrangement of perforation member 26, as well as the diameter of the needles used for needle points 28.

In the particular embodiment of the present invention shown in FIG. 2, a pair of guides 32, 34 are attached to apparatus 10 and used to hold support bar 30 in place against driven roller 16. As shown, each guide includes an associated channel (guide 32 including a channel 36, and guide 34 including a channel 38) for controlling the movement and placement of support bar 30. In a preferred embodiment, guides 32 and 34 are formed to allow for roller 30 to be retracted to allow for visual inspection of perforation member 26 and needle points 28.

It is to be understood that there exist many other arrangements for attaching rotating perforation apparatus 20 to a film unrolling apparatus (such as apparatus 10), where these attachment arrangements may be either permanent or removable. As long as perforation apparatus 20 is free to rotate against a driven film roller with a pliable surface, the action of creating perforations in an unrolling film will take place in accordance with the teachings of the present invention.

Figure 3:
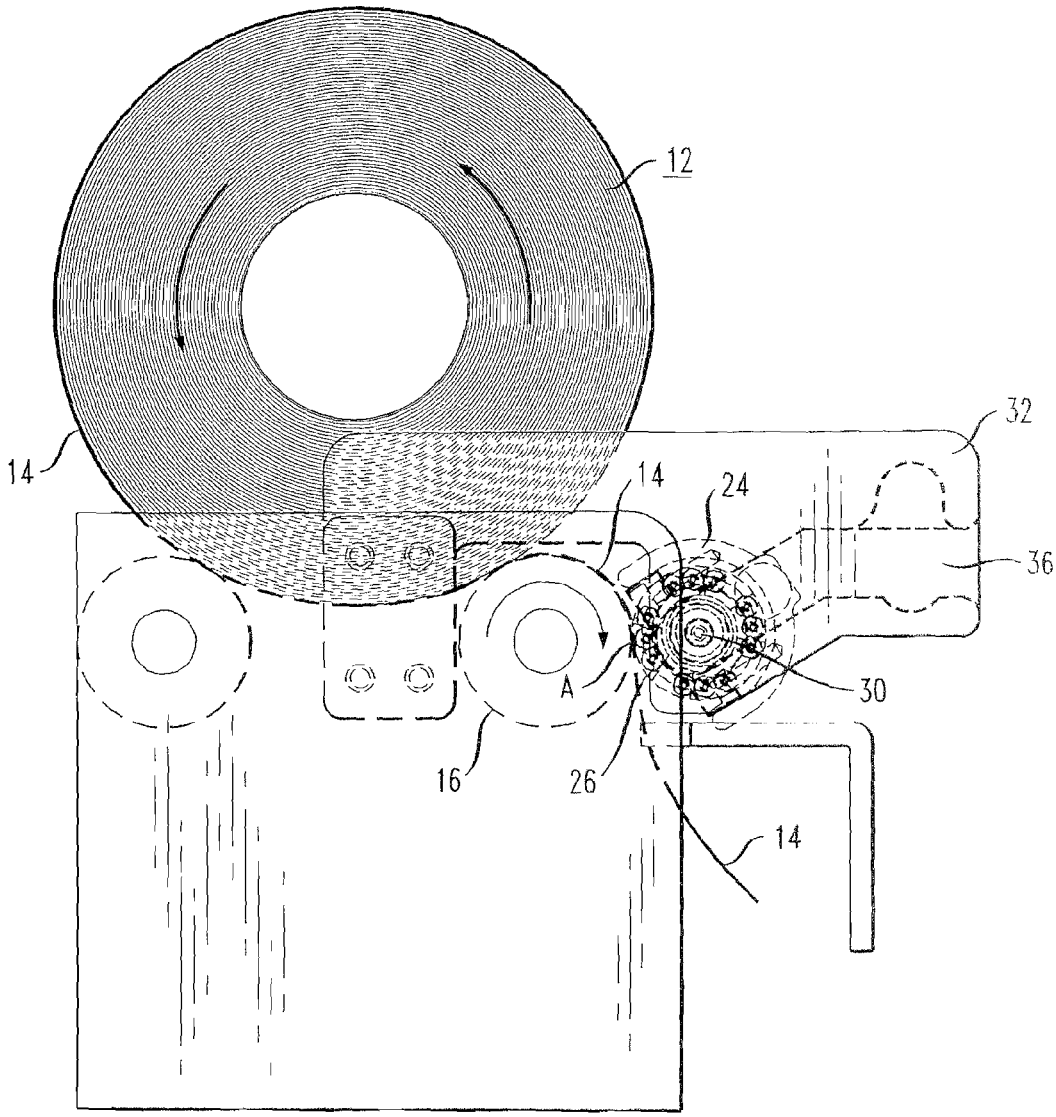
FIG. 3 is a side view of this same arrangement of the present invention.

FIG. 3 is a side view of this same arrangement of the present invention, in this view showing the placement of perforation member 26 against a portion of driven roller 16 as film 14 is fed between the two components. Also shown in this view (in phantom) is channel 36 formed within guide 32. Film 14 is exaggerated in thickness in the view of FIG. 3 in order to clearly show how the film exits roll 12 and passes between driven roller 16 and perforation member 26. Location A illustrates the position where needle points 28 on perforation member 26 come into contact with film 14, piercing the film and coming to rest against the pliable surface of roller 16. The interaction between needle points 28 and driven roller 16 will result in perforation member 26 rotating counterclockwise as driven roller 16 rotates in a clockwise fashion, allowing perforations to continue to be made in film 14 as it passes along.

Figure 4:
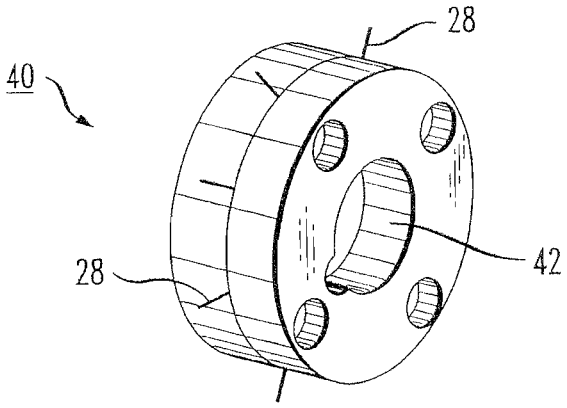
FIG. 4 is an isometric view of an exemplary needle-carrying ring of the perforation apparatus of the present invention.
Figure 5:
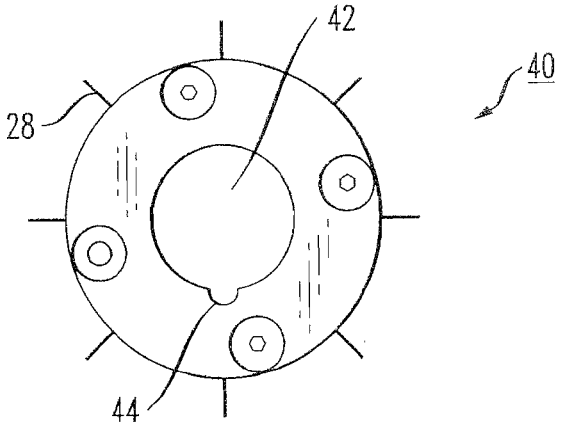
FIG. 5 is a top view of the ring of FIG. 4.

While needle points 28 may be directly formed on the support bar, a preferred embodiment of the present invention utilizes a perforation member 26 consisting of a plurality of separate rings 40 which may be placed alongside one another to form member 26. FIG. 4 is an isometric view of an exemplary ring 40, including a central aperture 42 for positioning over support bar 30 (see FIG. 2). A number of needle points 28 are shown as disposed around the circumference of ring 40 in predetermined locations. The length of points 28 is exaggerated in this view so as to show their placement around the periphery of ring 40. In order to provide alignment between needle points 28 from one ring to the next, each ring 40 is formed to include a keying feature 44, which will mate with a key 46 on support bar 30 (see FIG. 2). Keying feature 44 is best shown in FIG. 5, which is a top view of ring 40.

Figure 6:
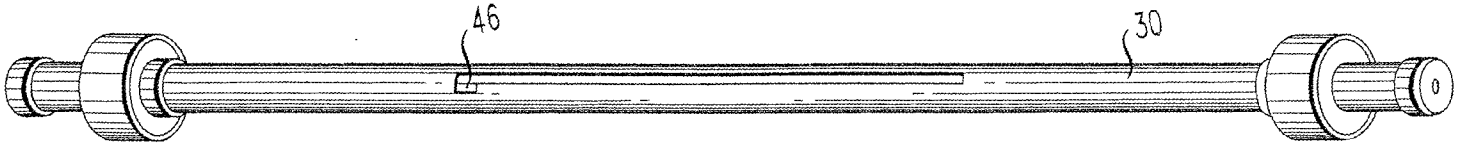
FIG. 6 illustrates an exemplary support bar for use in one embodiment of the present invention, in this view illustrating in particular a keying arrangement for use in fixing the needle-carrying rings (see FIG. 5) in place therealong.

FIG. 6 illustrates an exemplary support bar 30 of the perforation apparatus of the present invention, with perforation member 26 removed to clearly show the placement and extent of key 46. Again, such a keying arrangement is considered to be exemplary only. Various other arrangements for fixing/aligning rings 40 (or any other embodiment of perforation member 26) may be contemplated and are considered to fall within the scope of the present invention. Indeed, for embodiments where the needle points are directly formed on the exterior surface of support bar 30, there is no need to form such a keying element.

Figure 7:
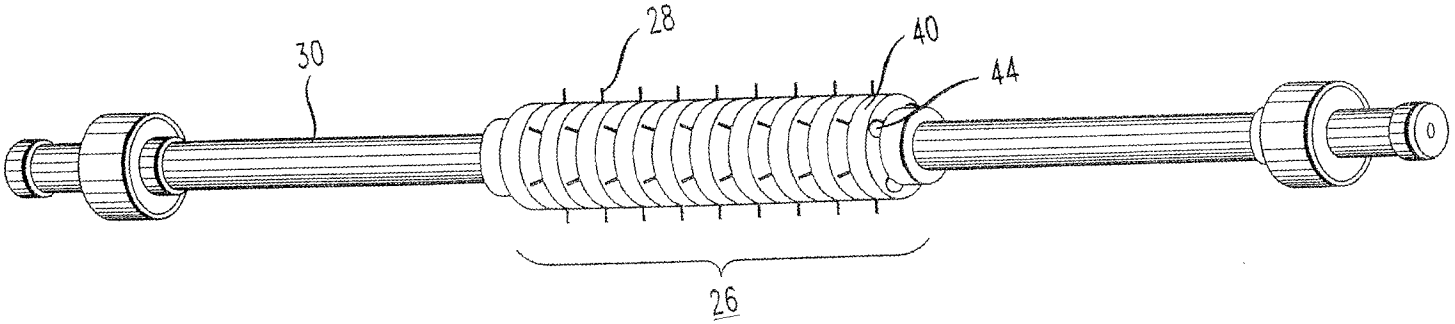
FIG. 7 is a view of the exemplary support bar of FIG. 6, with a plurality of needle-carrying rings disposed in position therealong.

FIG. 7 illustrates the same exemplary support bar 30 as shown in FIG. 6, in this illustration with a plurality of rings 40 disposed along bar 30 and "locked" in place by inserting the individual keying features 44 of rings 40 into key 46 of bar 30. Advantageously, the use of the keying arrangement provides both physical attachment of rings 40 to support bar 30 and alignment of needle points 28 from one ring to the next.

Figure 8:
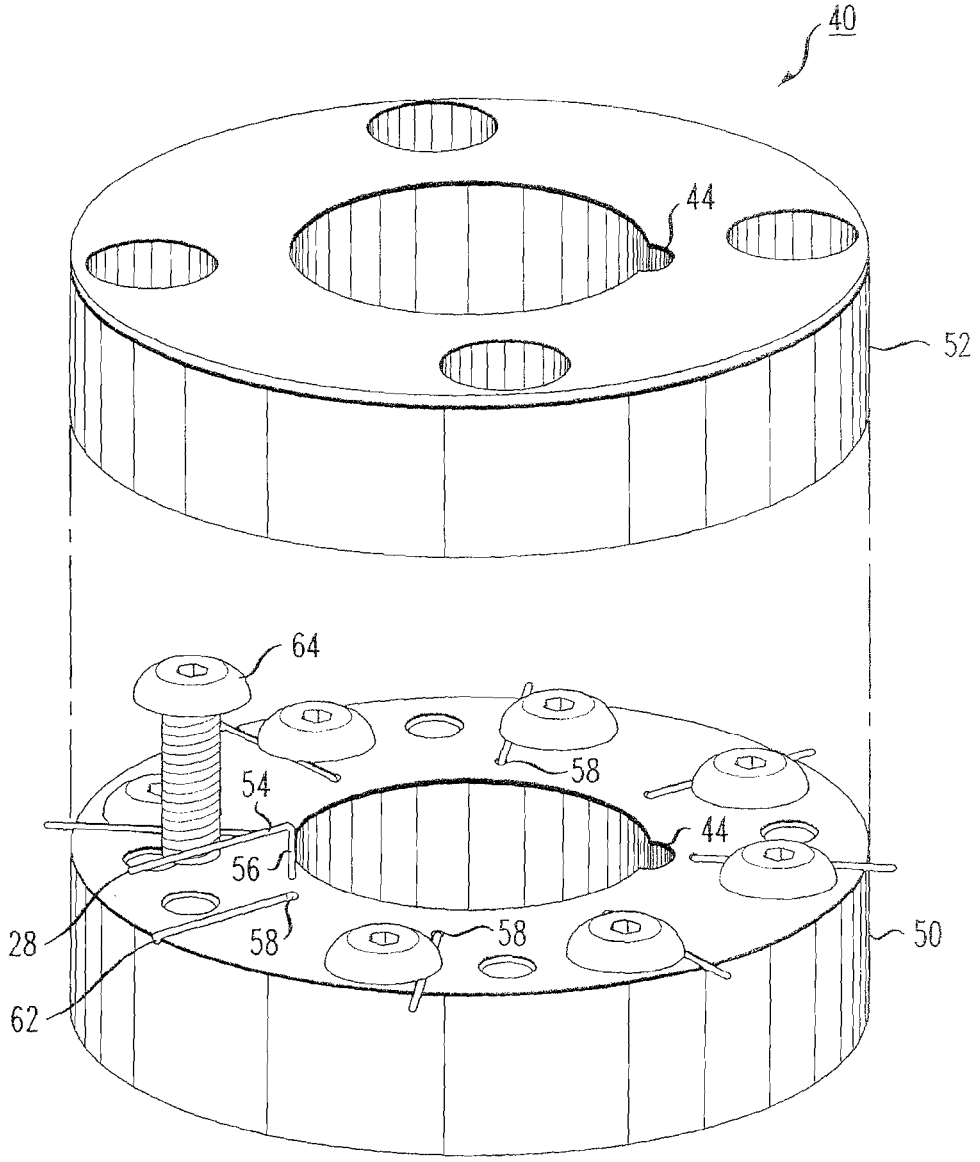
FIG. 8 is an exploded view of an exemplary needle-carrying ring, showing in particular an arrangement for inserting removable needles into a ring structure.

FIG. 8 is an exploded view of an exemplary ring 40. As shown, ring 40 comprises a bottom element 50 and a top element 52, with a plurality of needles 54 disposed therebetween such that needle points 28 will be exposed when elements 50 and 52 are joined together. For the sake of clarity, only one needle 54 is illustrated in FIG. 8. In this particular arrangement, needle 54 is L-shaped, with short leg 56 placed within a mating aperture 58 in bottom element 50. Side leg 60 of needle 54 rests within a groove 62 formed in the top surface of bottom element 50, with the end tip remaining exposed as needle point 28. The length of the exposed point 28 is determined by the position of aperture 58 relative to the length of needle 54 and the diameter of bottom element 50. A locking element 64 (in this embodiment, a screw) is used to hold needle 54 motionless in place along groove 62. Once the plurality of needles 54 are in place, top element 52 is positioned over bottom element 50 (with keying features 44 aligned) and attached thereto to form ring 40.

It is to be understood that various other arrangements may be used to hold the needle points in position. Indeed, while the preferred embodiments may utilize removable needles, it is possible to utilize a perforation element with permanently-fixed needle points, where the entire element is then replaced when necessary.

As mentioned above, the arrangement of the present invention is capable of providing "in-line" perforation of wrapping film—that is, creating perforations in the film as it is being unrolled and presented to the product-to-be-wrapped. Alternatively, the arrangement of the present invention may be used to create rolls of perforated film which are then inventoried and used at a later date/location to wrap product. In the latter case, an extended width stock roll may be perforated, and then "sliced" into smaller widths which are used for various products. Advantageously, the perforation apparatus of the present invention may be configured to modify the perforation pattern across the width of the film, thus creating the ability to apply a number of different perforation patterns, each pattern associated with a different "slice" when the extended width stock roll is separated into its separate components.

Figure 9:
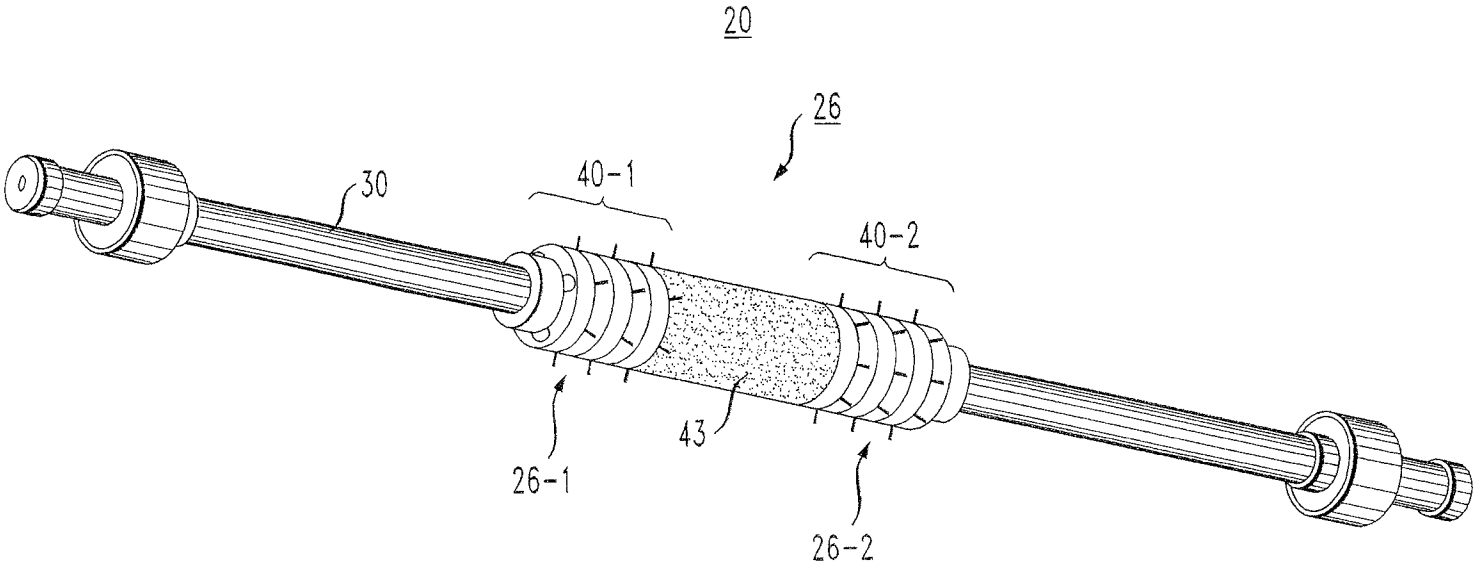
FIG. 9 is an alternative embodiment of the present invention, modifying the placement of the perforation-creating needles along the perforation member.

FIG. 9 contains an exemplary arrangement of rotating perforation apparatus 20 which provides for a modified perforation pattern, as discussed above. In this case, a first set of rings 40-1 is disposed at a first end 26-1 of perforation member 26. A spacer element 43 is disposed adjacent to rings 40-1, where spacer element 43 does not include any needle points. A second set of rings 40-2 is disposed at a second, opposing end 26-2 of perforation member 26. In accordance with this embodiment of the present invention, the number and placement of needle points 28 within second set of rings 40-2 may differ from the needle point placement within first ring 40-1. With this particular arrangement, therefore, an unrolling film will be processed to contain perforations along its two outer sections, the central portion remaining untouched. Thereafter, the film stock may be "sliced" into three different sections, each having been processed in accordance with its individual requirements.

Figure 10:
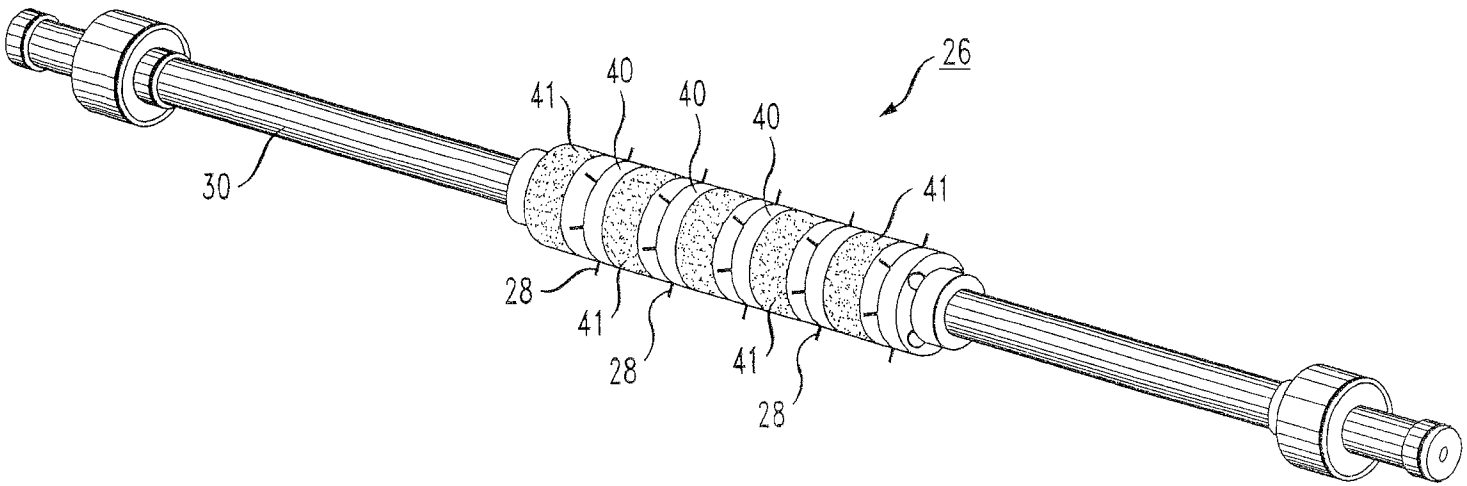
FIG. 10 is yet another embodiment of the present invention showing yet another pattern of needles across the perforation apparatus.

It is to be understood that various other combinations of needle point patterns and blank spacings may be used in creating any desired perforation pattern along the perforation apparatus of the present invention. For example, FIG. 10 illustrates an embodiment where the needle point pattern is modified by alternating "blank" rings 41 with rings 40 including needle points 28. Many other arrangements are possible and all are considered to fall within the spirit and scope of the present invention.

Indeed, the scope of the present invention is seen to include any type of in-line arrangement disposed adjacent to a driven roller associated with unrolling a wrapping film, allowing for perforations to be made in the film as it is passing over the driven roller, eliminating the need for a separate "perforating" process to be employed. While various ones of the preferred embodiments of the present invention have been described above, it is to be understood that the spirit and scope of the present invention is only to be limited by the claims appended hereto.

What is claimed is:

1. A method of creating perforations in a wrapping film, the method including the steps of:

a) providing a free-wheeling support bar including a plurality of needle points disposed around the perimeter thereof in a predetermined pattern;

b) placing the free-wheeling support bar in contact with a driven roller used to unroll wrapping film from a stock roll, the driven roller formed of a pliable material, with the free-wheeling support bar placed in contact with the driven roller such that as the driven roller is powered to rotate, the free-wheeling support bar rotates in a counter direction;

c) threading the wrapping film between the driven roller and the free-wheeling support bar so that the wrapping film is in contact with both the driven roller and the free-wheeling support bar;

d) activating the driven roller to rotate and unroll the wrapping film from the stock roll, the activation of the driven roller causing the free-wheeling support bar to counter-rotate; and present needle points against the pliable driven roller in a continuous manner; and e) piercing the wrapping film passing between the driven roller and the free-wheeling support bar with the counter-rotating needle points to create perforations in the wrapping film.

2. The method as defined in claim 1, wherein the method further comprises the step of f) creating a large role of perforated wrapping film.

3. The method as defined in claim 1 wherein the method further comprises the step of adjusting the size and placement of the plurality of needle points to provide the predetermined pattern of perforations on the wrapping film.

4. The method as defined in claim 1, wherein in performing step a), the method comprises the steps of:

providing a cylindrical support bar; and inserting a plurality of ring members on the cylindrical support bar, where at least one ring member includes a plurality of needle points formed on the outer surface thereof.

5. The method as defined in claim 4 wherein a first set of ring members includes a first plurality of needle points of a first dimension and spacing, and a second set of ring members includes a second plurality of needle points of a second dimension and spacing, such that at least two different perforation patterns are formed on the wrapping film as the support bar rotates against the driven roller.

6. The method as defined in claim 5 wherein the plurality of ring members is further modified to include at least one ring member without needle points.

7. The method as defined in claim 4 wherein the method of performing step a) further comprises the step of aligning the plurality of ring members along the support bar such that the predetermined perforation pattern is formed.

8. The method as defined in claim 7 wherein the aligning step is performed using a keying arrangement between the support bar and the plurality of ring members, with each ring member formed to include keying features that engage a key feature of the support bar.

9. The method as defined in claim 1 wherein the plurality of needle points are permanently formed on the outer surface of the support bar.

10. The method as defined in claim 1 wherein the plurality of needle points are removably attached to the outer surface of the support bar.

* * * * *